US009651919B2

(12) United States Patent
Merdanovic et al.

(10) Patent No.: US 9,651,919 B2
(45) Date of Patent: May 16, 2017

(54) SETTING DEVICE FOR A MINUTE HAND OF A TIMEPIECE, IN PARTICULAR OF A CHRONOGRAPH

(71) Applicant: Eterna AG Uhrenfabrik, Grenchen (CH)

(72) Inventors: Samir Merdanovic, Bettlach (CH); Patrick Kury, Langendorf (CH)

(73) Assignee: Eterna AG Uhrenfabrik, Grenchen (CH)

( * ) Notice: Subject to any disclaimer, the term of this patent is extended or adjusted under 35 U.S.C. 154(b) by 92 days.

(21) Appl. No.: 14/646,135

(22) PCT Filed: Nov. 12, 2013

(86) PCT No.: PCT/EP2013/073597

§ 371 (c)(1),
(2) Date: May 20, 2015

(87) PCT Pub. No.: WO2014/079736

PCT Pub. Date: May 30, 2014

(65) Prior Publication Data

US 2015/0301503 A1 Oct. 22, 2015

(30) Foreign Application Priority Data

Nov. 22, 2012 (CH) ..... 2474/12

(51) Int. Cl.

| | |
|---|---|
| ***G04B 19/02*** | (2006.01) |
| ***G04B 13/00*** | (2006.01) |
| ***G04F 7/08*** | (2006.01) |
| ***G04B 19/04*** | (2006.01) |

(52) U.S. Cl.

CPC ..... *G04B 19/02* (2013.01); *G04B 13/003* (2013.01); *G04B 19/04* (2013.01); *G04F 7/0804* (2013.01)

(58) Field of Classification Search

CPC ..... G04B 19/02; G04B 19/04; G04B 13/003; G04F 7/0804

USPC ..... 368/106

See application file for complete search history.

(56) References Cited

U.S. PATENT DOCUMENTS

2007/0091727 A1* 4/2007 Bonvin ..... G04F 3/022 368/107
2008/0304368 A1* 12/2008 Courvoisier ..... G04F 7/089 368/101

FOREIGN PATENT DOCUMENTS

| | | | |
|---|---|---|---|
| DE | 19852347 | A1 | 5/2000 |
| EP | 1953612 | A2 | 8/2008 |
| FR | 849143 | A | 11/1939 |

* cited by examiner

*Primary Examiner* — Amy Cohen Johnson
*Assistant Examiner* — Jason Collins
(74) *Attorney, Agent, or Firm* — The Webb Law Firm

(57) ABSTRACT

A minute hand of a timepiece has a central arbor, on which, for driving around the same: a gearwheel is fixed in a first accommodating region, a flyback device is fixed in a second accommodating region, and a snail cam is arranged with an interference fit in a third accommodating region. The snail cam has an opening for accommodating the head of an eccentric and the flyback device has an opening for accommodating the finger of the eccentric, and therefore rotation of the eccentric head, via the flyback device fixed on the central arbor, makes it possible to rotate the snail cam by an angle about the central arbor relative to the gearwheel for setting the triggering point of the advancement operation by the minute control level.

9 Claims, 3 Drawing Sheets

SETTING DEVICE FOR A MINUTE HAND OF A TIMEPIECE, IN PARTICULAR OF A CHRONOGRAPH

CROSS-REFERENCE TO RELATED APPLICATIONS

This application is the United States national phase of International Application No. PCT/EP2013/073597 filed Nov. 12, 2013, and claims priority to Swiss Patent Application No. 02474/12 filed Nov. 22, 2012, the disclosures of which are hereby incorporated in their entirety by reference.

BACKGROUND OF THE INVENTION

Field of the Invention

The present invention relates to a setting device for a minute hand of a timepiece, in particular of a chronograph, with a central arbor which bears a seconds hand and which has a plurality of receiving regions, with a gearwheel which is fixedly connected on the central arbor for driving about the latter in a first receiving region, with a heart-shaped reset to zero mechanism which is fixedly fastened on the central arbor for driving about the latter in a second receiving region, with a release snail cam which is arranged on the central arbor for driving about the latter in a third receiving region and which has a radially encircling control cam which rises in a ramp-like manner and along which a trip-dog of a minute control lever, which is pivotable about a pivot axis, slides under resilient prestress during the rotational movement of the release snail cam and, after a sliding distance corresponding to sixty seconds and overcoming the point of the largest radius, drops onto the point of the smallest radius of the release snail cam, with a minute control pawl which is arranged on the minute control lever and by means of which, when the trip-dog of the minute control lever drops onto the point of the smallest radius of the control cam, a minute counter wheel which is mounted rotatably can be advanced by a minute step, wherein the release point of the advancement can be set in an adjustable manner by the minute control lever.

Description of Related Art

A setting device for a minute hand of a timepiece is known from EP 1 953 612.

In the case of timepieces, at the moment of the zero passage of the seconds hand, both the trip-dog of the minute control lever is intended to drop onto the point of the smallest radius of the release snail cam and the minute counter wheel is intended to advance via the control lever and the control pawl by a step. Due to tolerances during the production and assembly, the simultaneouseous of said two functions cannot easily be achieved. In EP 1 953 612, an adjustment possibility with the aid of an eccentric is provided for this purpose, in which an opening which receives the head of the eccentric is provided in the minute counter wheel. A finger of the eccentric then engages in the release snail cam and, by rotation of the eccentric head, permits a variation in the setting of the angle of the release snail cam with respect to the gearwheel. The angular point at which the trip-dog of the setting lever drops from the point of the largest radius onto that of the smallest radius can thereby be set.

A disadvantage of the solution according to this prior art document is that, for the use of the eccentric, the gearwheel has to be realized in a corresponding material thickness. A certain moment of inertia is associated therewith because of the radial extension of the gear wheel and the radially remote material provided as a result.

Another earlier solution to this problem is known from DE 198 52 347, in which the trip-dog of the minute control lever itself can be set in the circumferential direction of the control cam. For this purpose, an eccentric with which the position of the point of the trip-dog can be set is provided on the minute control lever itself.

SUMMARY OF THE INVENTION

Further embodiments are indicated in the dependent claims. Starting from this prior art, the invention is based on the object of indicating a setting possibility for the minute hand of a timepiece, which permits this adjustment possibility in a simple manner.

Owing to the fact that the minute wheel is designed right at the bottom as a thin gearwheel, it is possible to arrange the release snail cam in an interference fit below the heart-shaped reset to zero mechanism such that the head of the eccentric is inserted in the heart-shaped reset to zero mechanism realized in a greater material thickness, and the finger of the eccentric in the release snail cam likewise realized in a greater material thickness. However, during the construction, these two elements, of course, take up a smaller diameter, and therefore the setting according to the present invention is associated with a lower moment of inertia.

The release snail cam which corresponds to the number 6 in external shape is advantageously provided in the region between the smallest and largest radius with a recess which permits the trip-dog of the minute control lever to spring back.

BRIEF DESCRIPTION OF THE DRAWINGS

Preferred embodiments of the invention are described below with reference to the drawings which merely serve for explanation and should not be interpreted as being restricting. In the drawings.

DESCRIPTION OF THE INVENTION

Figure 1:
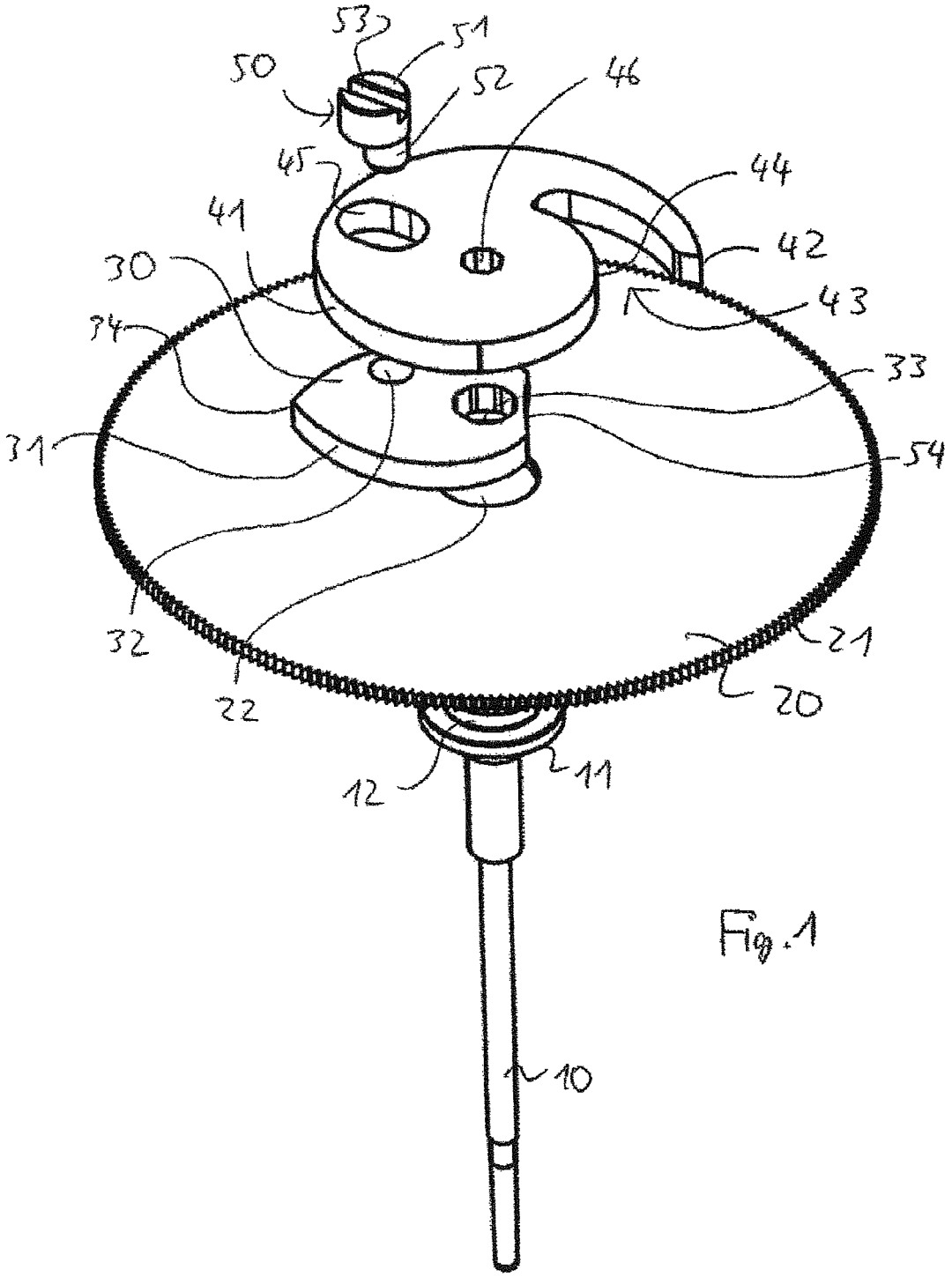
FIG. 1 shows a perspective exploded view of an exemplary embodiment of a setting device for the minute hand of a timepiece.

FIG. 1 shows a perspective exploded view of an exemplary embodiment of a setting device for the minute hand of a timepiece according to the invention. The illustrated minute hand of the timepiece, in particular of a chronograph, comprises a central arbor 10 which is drivable rotatably by a movement (not illustrated) and on which a seconds wheel or fourth wheel 20 and a heart-shaped reset to zero mechanism 30 are arranged one above the other for conjoint rotation. Furthermore, a release snail cam 40 is provided in an interference fit on the two elements mentioned.

Furthermore, the timepiece advantageously has a seconds hand (not illustrated in the drawings), the point of the hand of which follows a seconds dial (likewise not illustrated). The seconds hand here is in a fixed angular position with the fourth wheel 20.

The radially encircling lateral surface 41 of the release snail cam 40 has a control cam which rises in a ramp-like manner and merges from the point thereof with the largest radius 42 radially onto a point with the smallest radius 44. In the process, said control cam overcomes a V-shaped incision 43 which will also be described subsequently.

Figure 2:
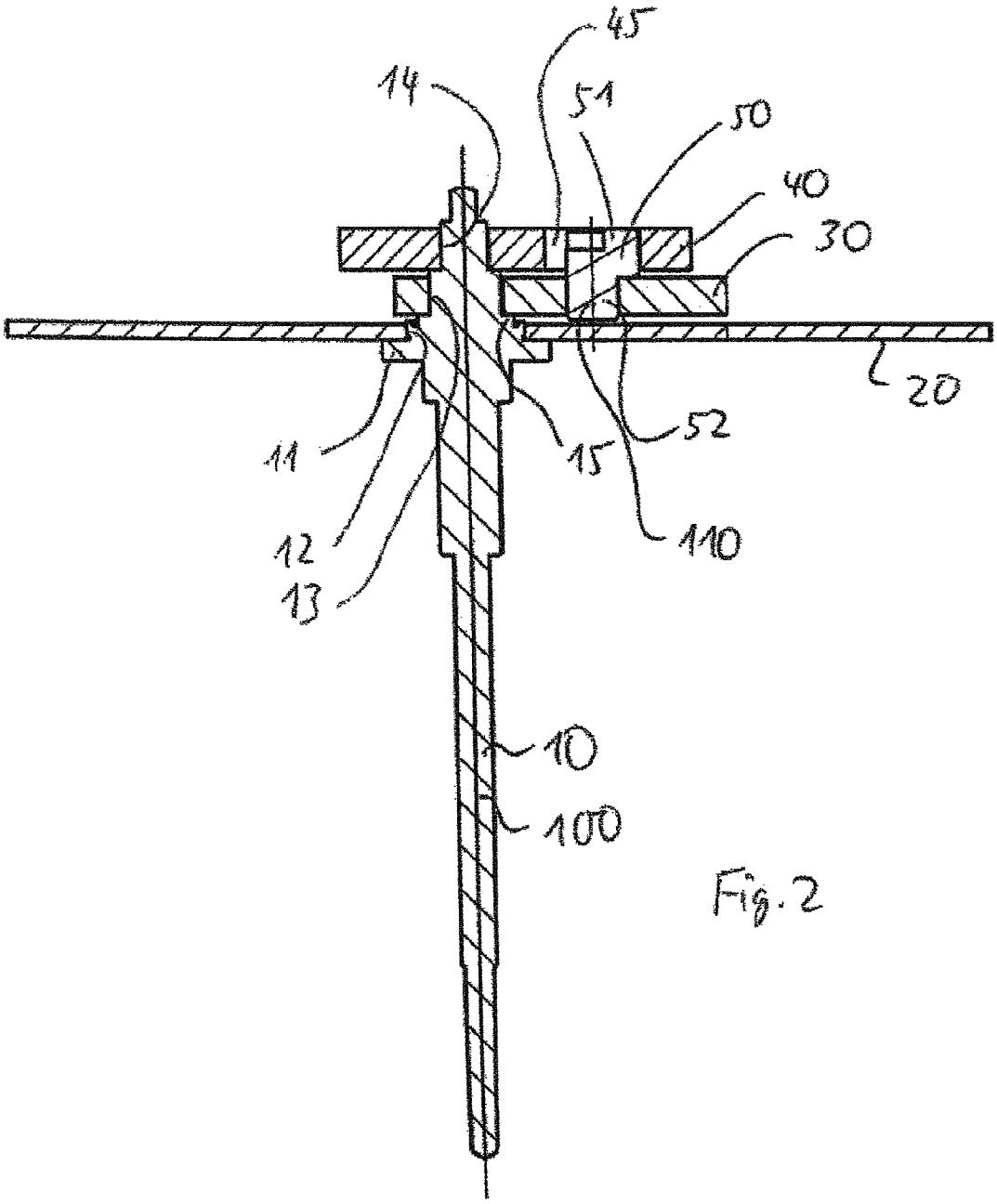
FIG. 2 shows a sectioned side view of the setting device according to FIG. 1.

The more detailed assembly of the individual elements can be seen better from the sectional view of FIG. 2 which shows the assembled components from FIG. 1. The central arbor 10 which is driven via the gearwheel 20, which is fixedly connected thereto, is illustrated centrally on the longitudinal axis 100. The outer edge of the gearwheel 20 has a multiplicity of teeth in which a drive (not illustrated further) engages. The gearwheel 20 rests on a stop flange 11 which protrudes beyond a first receiving region 12 on which the gearwheel 20 is inserted by the fastening hole 22 thereof. The gearwheel 20 is preferably connected to the central arbor 10 by a riveted joint. The diameter of the first receiving region 12 is customarily larger than a spacer step 15 on which the heart-shaped reset to zero mechanism 30 is placed. The heart-shaped reset to zero mechanism 30 is fastened fixedly here and rotates together with the arbor 10. Said heart-shaped reset to zero mechanism 30 is oriented in such a manner that a reset to zero lever of the seconds hand, said reset to zero mechanism acting on the setting surface 54, sets the seconds hand to zero on the dial thereof. This fastening of the heart-shaped reset to zero mechanism 30 is realized without tolerances in the second receiving region 13.

The third receiving region 14 in turn has a smaller diameter of the arbor 10 than the second receiving region 13, thus forming a step on which the release snail cam 40 is placed. The release snail cam 40 is in an interference fit here and is mounted rotatably in the event of action of a force in relation to the arbor 10. The heart-shaped reset to zero mechanism 30 is provided with an eccentric hole 32 which is arranged at a distance from the axis 100 of the central arbor 10, which axis is denoted in FIG. 2 by the axis 110.

The release snail cam 40 itself has an elongated hole 45 which runs radially with respect to the fastening hole 46 thereof, has a larger diameter than the eccentric hole 32 in the heart-shaped reset to zero mechanism 30 and runs symmetrically with respect to the axis of rotation 110 in the radial direction.

An eccentric 50, the cylindrical finger 52 of which is configured substantially matching the hole 32 and engages therein, is inserted into the two holes 45 and 32 mentioned. The cylinder head 51 of the eccentric 50, which cylinder head is likewise of cylindrical configuration but has a different axis of symmetry, is inserted in the hole 45. The effect which can therefore be achieved by rotation of the head 51 of the eccentric 50 over the fastening slot 53 is that the position of the eccentric head 51 in the elongated hole 45 changes between the position illustrated in FIG. 2 (radially outermost position) and the opposite position. During this rotation of the eccentric 50 about the axis 110, the angular setting of the cam disk 40 in relation to the heart-shaped reset to zero mechanism 30 and therefore in relation to the gearwheel 20 changes.

It should be emphasized that the radial elongated hole 45 permits this movement to a greater extent since, in the case of a precisely fitting pairing of hole 32 and finger 52 and hole (45) and head 51, the setting possibilities would be highly limited since each relatively great rotation of the head 52 of the eccentric 51 is also associated with a radial change in distance of the head 52 in the release snail cam 40 since the finger 52 is not capable of such an adaptation in the precisely fitting hole 32.

In an exemplary embodiment which is not illustrated in the drawings, the hole 32 is a radial elongated hole for a radial movement of the finger 52 during a rotational movement of the eccentric with an angular setting between release snail cam 40 and heart-shaped reset to zero mechanism 30, and the hole 45 is a continuous round hole which precisely receives the head 52.

In both cases, the hole 32 in the heart-shaped reset to zero mechanism 30 could also be a blind hole.

Figure 3:
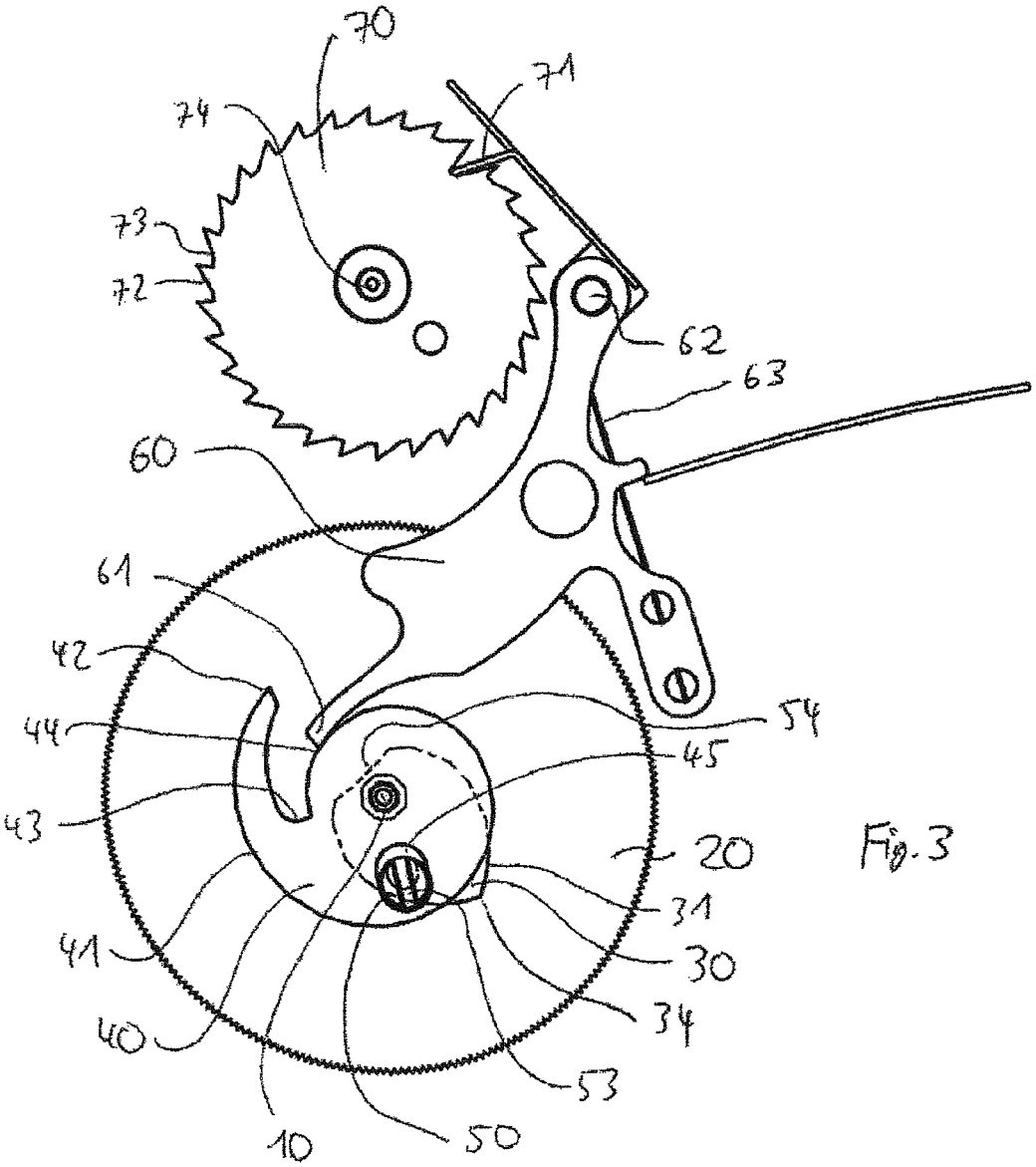
FIG. 3 shows a top view of the setting device according to FIG. 1 with further components of the minute counter wheel.

FIG. 3 now shows a top view of the setting device according to FIG. 1, in which further components of the minute counter wheel are illustrated. In particular, the pawl lever 60 which rotates about an axis 62, which is parallel to the axis 100 or 110, is illustrated. At a free end, the pawl lever 60 has a trip-dog 61 which is pressed against the control cam 41 of the release snail cam by the action of the leaf spring 63. In the event of rotation of the gearwheel 20 counterclockwise, the trip-dog 61 runs on the control cam 41 at an increasing distance from the axis 100 as far as the point of the maximum radius distance 42 in order then to fall back onto the time (illustrated in FIG. 3) and position of the smallest radius distance 44. At the time of the largest radial distance, the minute control pawl 71 which is mounted in relation to the pivot axis 62 at another free end of the lever 60 is disengaged from the saw teeth 72 of the minute counter wheel 70. In this exemplary embodiment, the minute counter wheel 70 has thirty saw teeth 72 with corresponding tooth spaces 73. In the exemplary embodiment illustrated, the thirty teeth are not all identical; the tooth space 73 in which the pawl 71 engages in the drawing is much deeper than the other tooth spaces. In other exemplary embodiments which are not illustrated in the drawings, the teeth 73 can also all be configured identically.

It can readily be seen from FIG. 1 that, with the solution according to the invention, the eccentric wheel 50 is inserted into two components realized in a greater material thickness, namely the heart-shaped reset to zero mechanism 30, on which a lever (not illustrated in the figures) can act in the region of the setting surface 54 if a zero position is intended to be adopted; and into the release snail cam 40 in which the likewise somewhat thicker trip-dog 61 of the setting lever 60 engages. It is therefore possible for gearwheel 20 to be of thin design and therefore to effectively reduce the mass of the inert system. The terms thin and thick in this respect should be understood as follows. The material thickness of the gearwheel 20 is smaller than the material thickness of the release snail cam 40 in the axial direction of the arbor 20. The material thickness of the gearwheel 20 is smaller than the material thickness of the heart-shaped reset to zero mechanism 30 in the axial direction of the arbor 10. Similar or identical material thicknesses of heart-shaped reset to zero mechanism 30 release snail cam 40 are then advantageously produced. The thickness of the setting lever 60 in this axial direction is then comparable, but is not greater than the thickness of the release snail cam 40.

It has turned out in tests that the interference fit of the release snail cam 40 is adequate for the two functions associated therewith. Firstly, the release snail cam 40 sits sufficiently securely on the central arbor 10 and, secondly, it is possible with the aid of inserting a tool into the slot 53 and exerting a force for rotating the eccentric head 51, to change the angular position of the release snail cam 40 with respect to the heart-shaped reset to zero mechanism 30 and gearwheel 20. Depending on the configuration in terms of the ratio of diameter of the eccentric head 51 to the diameter of the finger 52, the elongated hole 45 here permits an angular movement by a number of degrees, for example between 1 and 10 degrees or 2 to 5 degrees.

The eccentric 50 is advantageously arranged remote from the axis 100 by the arrangement of the hole 32 in the heart-shaped mechanism 31 in such a manner that said eccentric is preferably provided in the region of the half of the control cam 41 at the greater radial distance from the center, i.e. on the far side of the imaginary radial line (on the left thereof in the drawing of FIG. 1) between the point of the largest radius 41 and the point of the smallest radius 44 beyond the center of the arbor 10 to the opposite side of the snail cam 41 where said line runs over the point 34 of the heart-shaped reset to zero mechanism 30. The elongated hole 45 then lies here within an angular segment of 30 degrees to the line of point 34⇆arbor 10 in order to profit from the still existing greater portion of material of the heart-shaped reset to zero mechanism 30 close to the point 34. In general, it is already of advantage if the central axis 110 of the opening 32 in the heart-shaped reset to zero mechanism 30 is provided within an angular range of −30 and +30 degrees about the imaginary connection between the axis of rotation 100 and the point 34 of the heart-shaped reset to zero mechanism 30.

Alternatively, the opening 32 can also be an elongated hole and the opening 45 a precisely fitting hole, and therefore the axis of rotation of the eccentric, which then replaces the axis 110, coincides with the axis of rotation of the head 51, and the finger 52 moves in an elongated hole. However, the exemplary embodiment described here has the advantage that, as can readily be seen in FIG. 3, a part of the eccentric head 51 in the elongated hole 45 is radially outside the control cam 31 of the heart-shaped reset to zero mechanism 30, and therefore the distance of the two axes of rotation 100 and 110 from each other, which both determine the transmission, is as great as possible.

In the exemplary embodiment illustrated, the sequence of the elements is release cam—heart-shaped reset to zero mechanism—fourth wheel in the direction of the longitudinal axis of the arbor 10. In an exemplary embodiment which is not illustrated in the drawings, the sequence is heart-shaped reset to zero mechanism—release cam—fourth wheel where the two upper, thicker elements are therefore provided in a reverse sequence, which is possible because of the functional setting of elongated hole 45 and hole 32. In a further exemplary embodiment, the fourth wheel 20 is provided with at least one aperture for the eccentric head, and therefore said fourth wheel can also be "at the top" (with respect to the drawing of FIG. 3), i.e. the sequence is fourth wheel—release cam—heart-shaped reset to zero mechanism. The eccentric head 51 is then arranged in such an aperture and acts from there in the release cam 40, which is illustrated in FIG. 3, but is then arranged below the fourth wheel 20, and in the heart-shaped reset to zero mechanism 30.

The invention claimed is:

1. A setting device for a minute hand of a timepiece comprising:

a minute control lever;

a minute control pawl which is arranged on the minute control lever;

a minute counter wheel which is mounted rotatably, a central arbor for a seconds hand, which central arbor has a plurality of receiving regions;

a gearwheel which is fixedly connected on the central arbor for driving about the central arbor in a first receiving region;

a heart-shaped reset to zero mechanism which is fixedly fastened on the central arbor for driving about the central arbor in a second receiving region;

an eccentric having a finger and a head; and a release snail cam arranged on the central arbor for driving about the central arbor in a third receiving region and having an opening for receiving the head of the eccentric, wherein the release snail cam has a radially encircling control cam which rises in a ramp-like manner between a smallest and a largest radius, and along which a trip-dog of the minute control lever, which is pivotable about a pivot axis, slides under resilient prestress during rotational movement of the release snail cam and, after a sliding distance corresponding to sixty seconds and overcoming a point of largest radius, drops onto a point of smallest radius of the release snail cam, wherein by way of the minute control pawl, when the trip-dog of the minute control lever drops onto a point of smallest radius of the control cam, the minute counter wheel is advanced by a minute step, wherein a release point of advancement is set in an adjustable manner by the minute control lever, wherein the release snail cam is arranged in an interference fit in the third receiving region of the central arbor, and wherein the heart-shaped reset to zero mechanism has an opening for receiving the finger of the eccentric, and by rotation of the head of the eccentric via the heart-shaped reset to zero mechanism sitting fixedly on the central arbor, the release snail cam is rotated by an angle about the central arbor relative to the gearwheel for setting the release point of the advancement by the minute control lever.

2. The setting device for a minute hand as claimed in claim 1, wherein the release snail cam has a recess behind a radial connection between the point of the largest radius and the point of the smallest radius.

3. The setting device for a minute hand as claimed in claim 1, wherein a central axis of the opening in the heart-shaped reset to zero mechanism is provided within an angular range of −30 and +30 degrees about an imaginary connection between an axis of rotation and a point of the heart-shaped reset to zero mechanism in order to obtain as large a distance as possible of an axis of rotation of the eccentric from the axis of rotation.

4. The setting device for a minute hand as claimed in claim 3, wherein the central axis of the opening in the heart-shaped reset to zero mechanism is provided within an angular range of 15 to 30 degrees on a side of the imaginary connection between the axis of rotation and the point of the heart-shaped reset to zero mechanism on which the release snail cam has a larger radius of the control cam thereof.

5. The setting device for a minute hand as claimed in claim 1, wherein the head of the eccentric is cylindrical, the finger of the eccentric is cylindrical, a longitudinal axis of the finger does not coincide with a longitudinal axis of the head, an opening receiving the head is a radially oriented elongated hole and the opening receiving the finger is an opening which substantially precisely receives the finger.

6. The setting device for a minute hand as claimed in claim 1, wherein a sequence of the three receiving regions on the central arbor, as seen from an engagement side of an actuating element of the eccentric, is release snail cam, heart-shaped reset to zero mechanism, and gear wheel.

7. The setting device for a minute hand as claimed in claim 1, wherein a sequence of the three receiving regions on the central arbor, as seen from an engagement side of an actuating element of the eccentric, is heart-shaped reset to zero mechanism, release snail cam, and gear wheel.

8. The setting device for a minute hand as claimed in claim 1, wherein the gear wheel has at least one aperture for receiving the head of the eccentric, and in that a sequence of the three receiving regions on the central arbor, as seen from an engagement side of an actuating element of the eccentric, is gear wheel, heart-shaped reset to zero mechanism, and release snail cam in a predetermined sequence.

9. The setting device for a minute hand as claimed in claim 1, wherein the timepiece is a chronograph.

* * * * *